United States Patent [19]

Broughton et al.

[11] Patent Number: 4,963,058

[45] Date of Patent: Oct. 16, 1990

[54] PROTECTIVE BARRIER FOR THE PROTECTION OF OFFSHORE MARINE WORKS, AND METHOD OF INSTALLATION OF THE SAME

[75] Inventors: Peter Broughton, Camberlay, England; Jean-Claude Berthin, Mennecy, France; Jean G. M. Martin, Paris, France; Gerard A. A. Barbaras, La Queue en Brie, France

[73] Assignee: Doris Engineering, France

[21] Appl. No.: 351,797

[22] Filed: May 15, 1989

[30] Foreign Application Priority Data

May 13, 1988 [FR] France ..... 88 06462

[51] Int. Cl.[5] ..... E02D 23/02; E02D 25/00

[52] U.S. Cl. ..... 405/207; 405/205; 405/203; 405/211; 405/217; 405/14

[58] Field of Search ..... 405/210, 211, 212, 217, 405/203, 204, 205, 207, 11, 12, 13, 14

[56] References Cited

U.S. PATENT DOCUMENTS

| | | | |
|---|---|---|---|
| 924,362 | 6/1909 | Leow | 405/13 |
| 3,197,968 | 8/1965 | Castellanos | 405/12 X |
| 3,710,579 | 1/1973 | Killmer et al. | 405/11 |
| 4,118,941 | 10/1978 | Bruce et al. | 405/204 |
| 4,504,172 | 3/1985 | Clinton et al. | 405/217 |
| 4,522,532 | 6/1985 | Tedrick | 405/11 |
| 4,767,238 | 8/1988 | Blanc | 405/203 X |

FOREIGN PATENT DOCUMENTS

| | | |
|---|---|---|
| 2277940 | 2/1976 | France . |
| 772082 | 4/1957 | United Kingdom . |
| 1425978 | 2/1976 | United Kingdom . |

OTHER PUBLICATIONS

Polytechnisch Tijdschrift Bouwkunde, Wegen- en Waterbouw, vol. 34, No. 11, Nov. 1979, pp. 705–715, La Haye, NL; J.C.M.M. Bovee: "Produktie-platforms van beton op het continentale plat van West-Europa".

*Primary Examiner*—Randolph A. Reese
*Assistant Examiner*—J. Russell McBee
*Attorney, Agent, or Firm*—Stevens, Davis, Miller & Mosher

[57] ABSTRACT

Protective barrier consisting of at least two ballastable elements (3, 4) adapted to surround at least partially the work to be protected (1).

The height of the individual elements is greater than the water depth. The elements comprise a connection device permitting the structural continuity of the elements after assembly. The protective barrier is entirely independent of the work to be protected. The positioning of the elements around the work is effected by means of a positioning system provided in the sea bed and/or the individual elements of the protective barrier.

6 Claims, 5 Drawing Sheets

PROTECTIVE BARRIER FOR THE PROTECTION OF OFFSHORE MARINE WORKS, AND METHOD OF INSTALLATION OF THE SAME

BACKGROUND OF THE INVENTION

This invention relates to a protective barrier for the protection of marine works, and in particular the problem of protection of marine works of large dimensions. It also relates to a method of installation of the protective barrier.

Means of protection are presently used for works on the sea coast or in river beds, such as coffer-dams consisting of sheet piles or of concrete structural elements, possibly assembled in watertight manner providing a zone sheltered from the currents and/or the waves.

These existing means are either of a temporary character, such as those used in the case of repairs or construction of elements of works anchored at the sea/river bed and generally enclose a relatively small surface; or else are of a permanent character such as jetty protection works which take the form of a wall supported by a solid embankment.

Such existing means are generally used only in depths of water less than some thirty meters. Beyond this depth, and for depths corresponding to those of the continental shelf (of the order of 200 m), it is necessary to adopt techniques akin to those of "off-shore" construction. In the latter case the means of protection form part of the main construction and are constructed at the same time as the work element or elements to be protected (e.g. piled or gravity structure intended to support the deck). Such a means of protection is described in French Patent No. 2,277,940, for example, and takes the form of a perforated circular wall integral with the slab and continuing above the water level so as to protect the hollow central tank from the waves and/or impact by floating bodies. The deck rests upon the central tank and columns provided on the top of the perforated wall at a height such that the facilities which it supports are beyond the reach of the highest waves.

The supporting structures of an offshore platform are normally dimensioned to withstand external loads such as those due to waves, wind, current, impacts by ships, ice forces, iceberg impacts, and for a definite period of service. During the course of this period of service, the environmental conditions may change, for example, an increase in the service period, modification of the loading conditions, increase in the water depth due to subsidence of the sea bed upon which the structure rests, or the reuse of the structure on another site, etc. These changes currently necessitate major modification works which may involve long-term stoppages of production/facilities and operations.

This invention aims at dissociating the functions of withstanding external environmental load from those of operating the production facilities, so as to permit installation of modifications without disturbing the operation of original platform/facilities.

The protective barrier, according to the invention, is characterized by the fact that it consists of an enclosure extending from the sea bed to a chosen height above the sea level, surrounding the work to be protected, consisting of at least two parts capable of being assembled along their vertical sides, each of the parts being constructed in the form of a ballastable cellular floating structure.

The explanations and figures given below by way of example will show clearly how the invention may be embodied.

Figure 1:
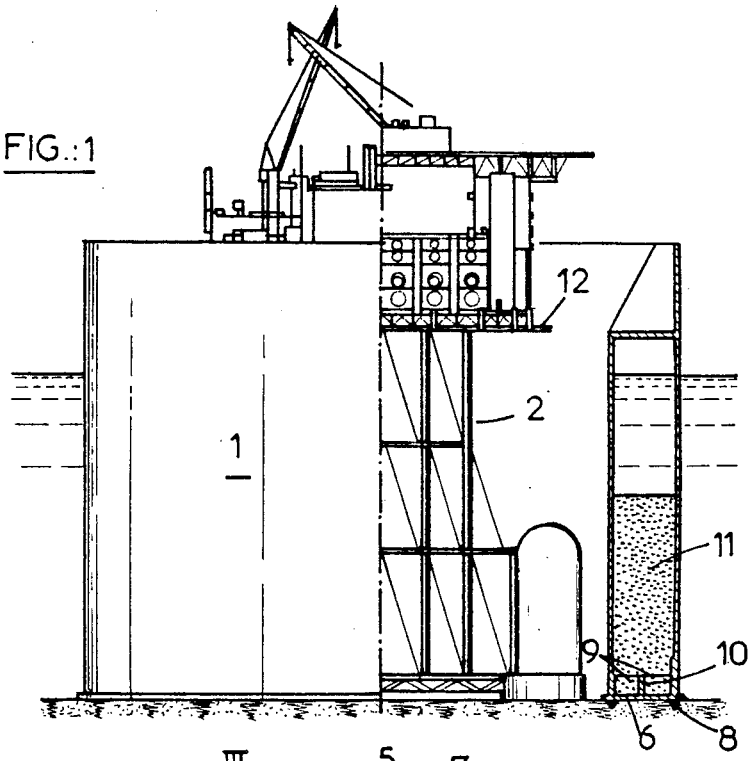
FIG. 1 shows a view of the protective barrier, according to the invention, in elevation and in partial section.
Figure 2:
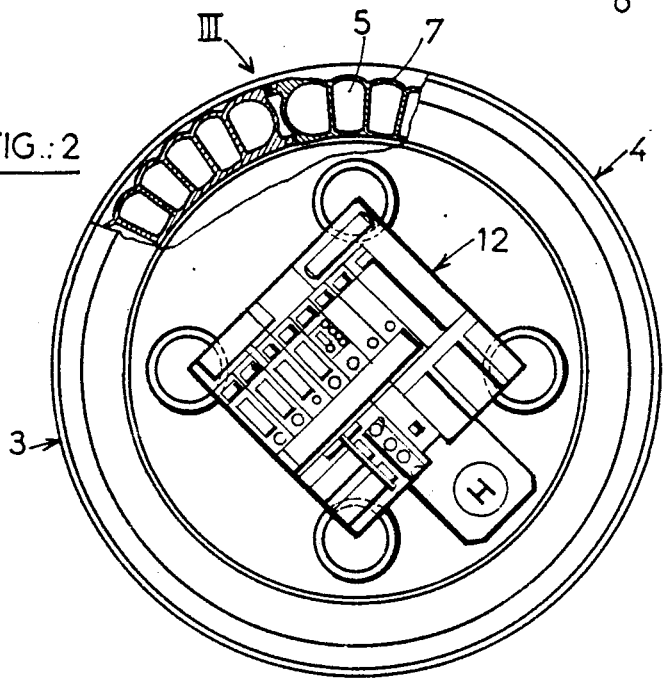
FIG. 2 is a partially sectional plan view of FIG. 1.
Figure 3:
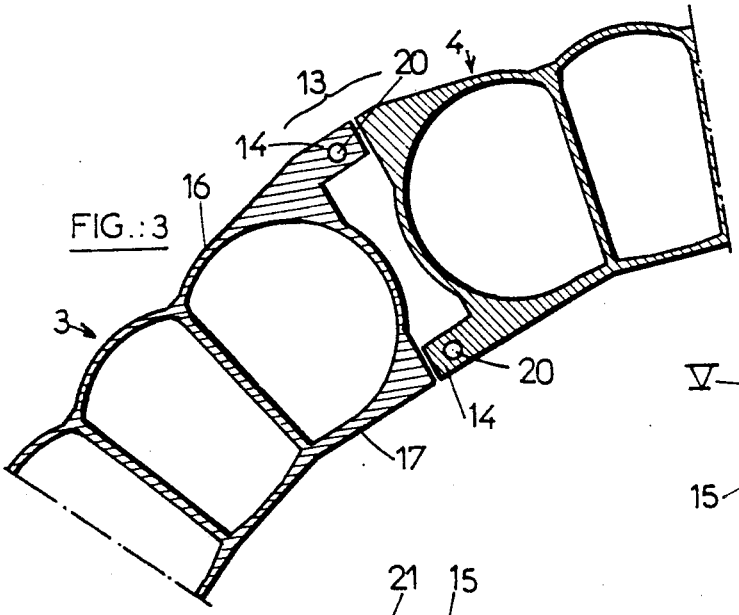
FIG. 3 is a larger scale view of the detail III of FIG. 2, showing the connecting device of the two elements of the protective barrier, according to the invention.
Figure 4:
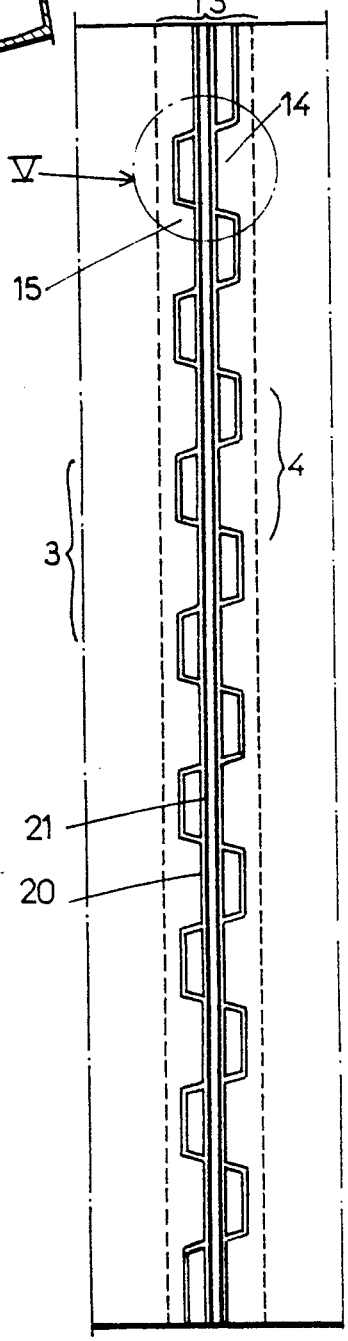
FIG. 4 is a sectional view of the connection device of the vertical sides of the elements of the protective barrier.
Figure 5:
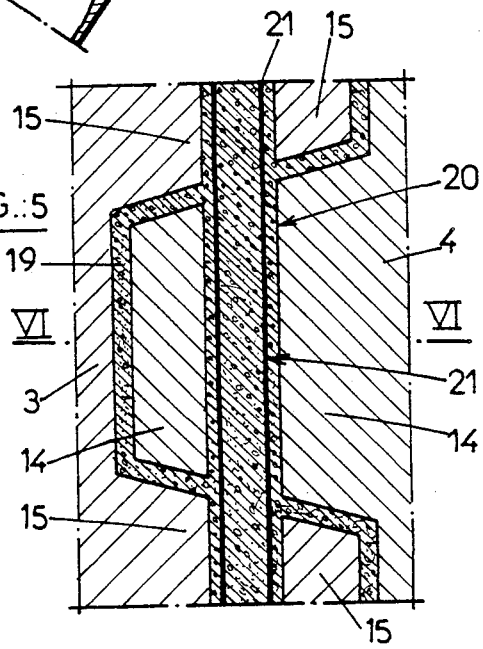
FIGS. 5 and 6 are respectively a larger scale view of the detail V of FIG. 4 and a sectional view along VI—VI of FIG. 5.
Figure 6:
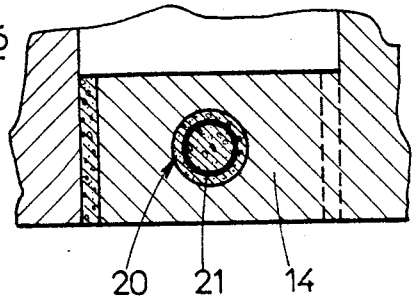

As defined by the examples shown on FIGS. 1 to 2, the protective barrier 1 is intended to surround an "offshore" platform (or work) 2 in order to protect it against the effects of floating bodies, currents, waves, etc. As shown, the protective barrier extends from the sea bed to a height above the mean water level which depends upon the type of external loading for which protection is required.

DETAILED DESCRIPTION OF THE DRAWINGS

As shown in FIG. 1, it is necessary to protect the platform and more particularly the deck, against the effects of the highest waves under storm conditions. These situations are likely to be met when a platform is reused on a deeper site or in the case of subsidence of the sea bed at the existing/original site.

As defined in the attached figures the protective barrier consists of two semi-circular cylindrical elements 3, 4 connected along two opposite generatrices.

The individual elements consist of prestressed reinforced concrete structures which have convex and concave external and internal walls and which subdivide the protective barrier into individual cells 5 with vertical axes, closed at their lower end by a base slab 6 in the form of an annular segment, adapted to rest upon the sea bed. According to the attached figures the external walls of the cells are of lobed shape in order to present greater resistance to hydrostatic pressures.

The base slab 6 has optional ribs projecting on the underside 8 which penetrate the sea bed to ensure stability of the protective barrier against lateral sliding. The lower part 9 of the cells, near the slab 6, is optionally divided by vertical partitions 10 integral with the base slab, and are intended to stiffen the latter to ensure good transmission of the forces to the vertical walls.

Alternatively the protective barrier may consist of a number of elements greater than two which are of equal dimensions or of different dimensions;

After assembly, the elements may surround the platform/structure (work) totally, as in the example illustrated, or surround it only partially.

The configuration of the external and/or internal wall of the elements is preferably inscribed in a regular polygon, and in the limiting case in a circle. However, other forms, such as an ellipse for example, might be considered, depending upon the form of the work to be protected.

The attached figures relate to an offshore platform, the square shaped deck 12 of which, and its facilities, are required to be protected from the highest waves, it is therefore necessary to provide a protective barrier 1 capable of totally surrounding said platform to a sufficient height.

The protective barrier must therefore be cylindrical, and of a diameter such that its location is close enough to the projecting parts of the platform, although without being attached mechanically to or supported by the latter, so as on the one hand to optimize the quantity of material involved in the construction of the protective barrier, having regard to the external loads to which it is subjected, and on the other hand not to interfere with the operation of the platform to be protected.

The elements 3 and 4 which form the protective barrier must be connected along their vertical sides, after positioning on the site which will be described later. During the construction of the individual elements, it may be necessary to equip their vertical sides with connection devices 13 which may, as shown in FIGS. 3 to 6, consist of teeth 14, 15 formed in both the external 16 and the internal 17 walls of the individual elements 3, 4 which are capable of meshing to leave a joint 19. The teeth are penetrated vertically by coaxial cylindrical channels 20, adapted to receive a locking pin 21 consisting of a locking pins of smaller diameter than that of the cylindrical channels, The structural continuity of the elements, after the engagement of the teeth and introduction of the locking pins, is achieved by injecting a cement slurry into the joints 19 of the cylindrical channels 20 and of the locking pins 21.

The structural linkage through the connection device 13 is developed by the combination of the teeth 14, 15, to transmit the vertical forces, and of the locking pins 21 to transmit the horizontal forces and to absorb the flexural moments about the vertical axis.

Figure 7:
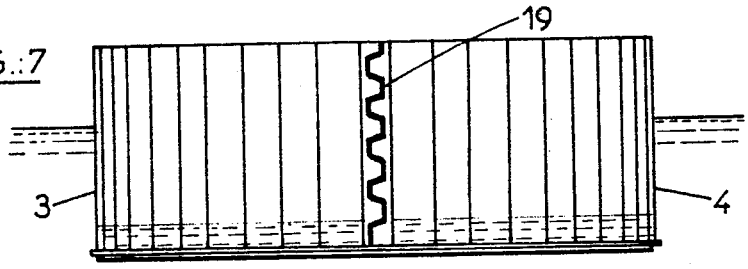
FIG. 7 a diagrammatic view of a phase of construction of the protective barrier.

The method of construction of the individual elements 3, 4 is similar to that of existing concrete gravity platforms. The base slab 6 and part of the vertical walls are constructed in a dry dock, and when the construction is sufficiently advanced to permit its flotation, the structure is floated (FIG. 7) and its construction is completed up to the required height in a suitable wet dock.

In order to facilitate the subsequent connection of the individual elements to each other, it is advantageous to construct them simultaneously in their final relative position so as to obtain compatible joints. The form of the joints is developed by the interposition of standing shutters which will be withdrawn when the elements are separated.

Figure 8:
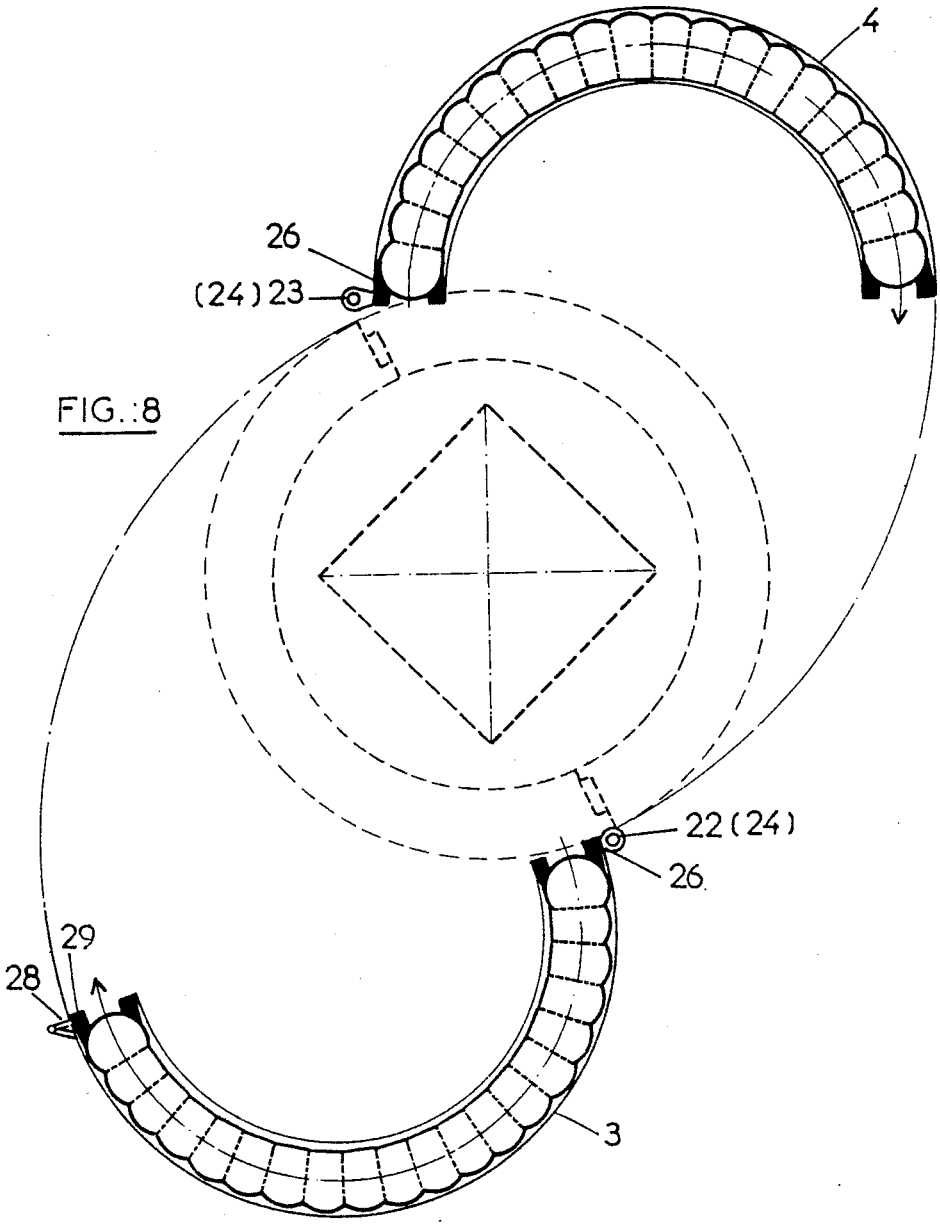
FIG. 8 is a diagrammatic view of the positioning of the protective barrier, around the existing platform/structure.
Figure 9:
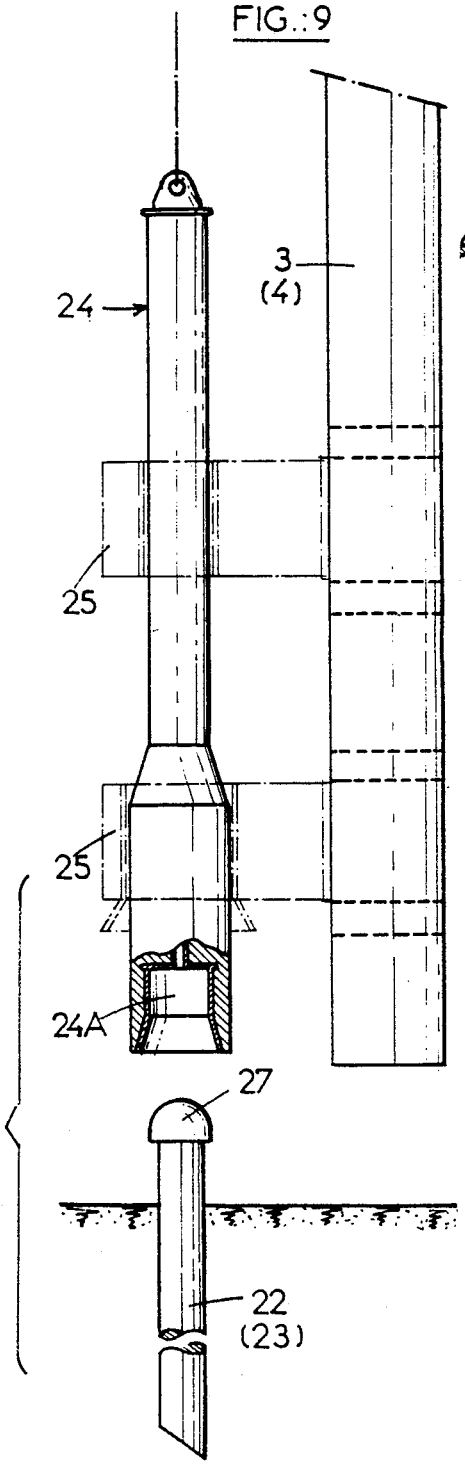
FIGS. 9, 10 and 11 are detailed views indicating the methods of relative positioning of the individual elements of the protective barrier.

The elements are towed, separately or together, from the construction site to the final site. A method of positioning and installation is then used which is illustrated diagrammatically in FIGS. 8 and 9 and which consists in bringing each element to a docking pile 22, 23 provided at a definite distance from the existing structure to be protected and in rotating said elements so as to form the proposed protective barrier.

The positioning of the elements relative to the existing offshore platform 1 is achieved by means of a docking mechanism, at least one part of which is carried by each of the elements 3, 4.

As previously stated, the positioning is effected by means of a docking mechanism comprising two docking piles 22 and 23 driven into the sea bed at a definite distance from the platform, so that the elements can be brought into the required position relative to the platform to be protected. For this purpose each of the individual elements 3 and 4 carries a docking sleeve 24 adapted to slide in guides 25 provided on the internal longitudinal side 26 of the element. Said docking sleeve is equipped at its lower end with a housing 24A provided to engage with the head 27 of the docking pile 22 and 23. The other end of the docking sleeve 24 is equipped with means for allowing a vertical movement, for example, with a cable operable from a winch provided on the top side of the element.

Figure 10:
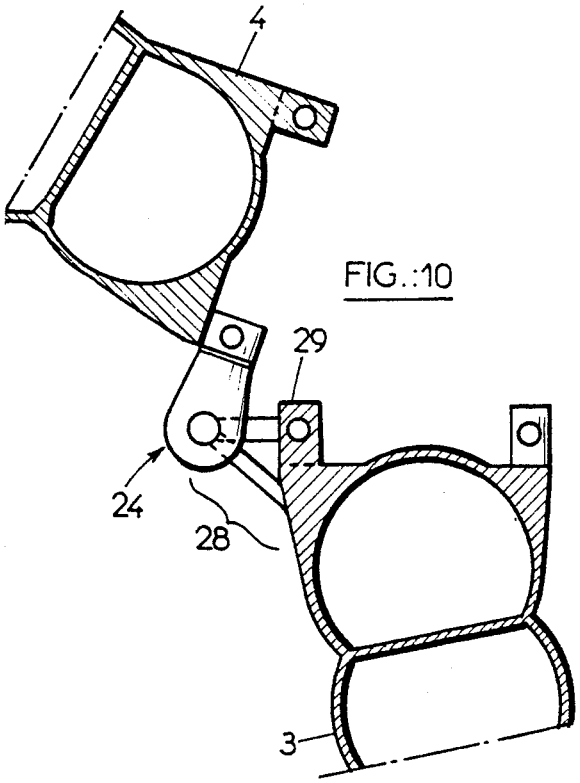
Figure 11:
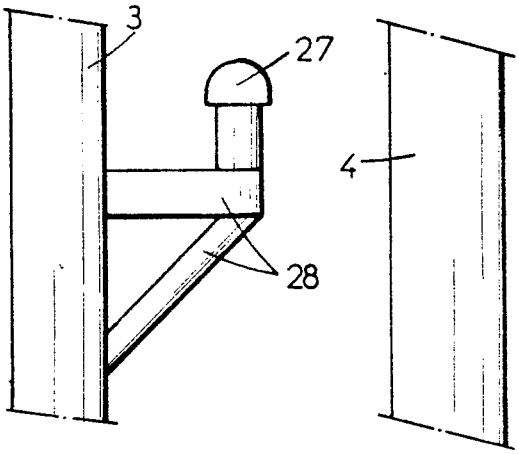

Alternatively, the element 4 is positioned relative to the first element 3 by means of a docking head 27 fixed on a lattice girder 28 on the vertical side 29 of the first element 3 (FIGS. 10 and 11) and of a docking sleeve 24 adapted to cooperate with said head 27.

The method of positioning and installation of the protective barrier, according to the invention is described below.

A first element 3 of the protective barrier is towed to the site. Previously at least three mooring piles 30, 31, 32 arranged in a star shape have been driven into the sea bed, to which a mooring line is attached, as shown, consisting of a length of chain, to the end of which a mooring cable carried by the element 3 will be attached through the intermediary of a winch.

At least one docking pile 22 has likewise been provided near the platform to be protected.

Figure 15:
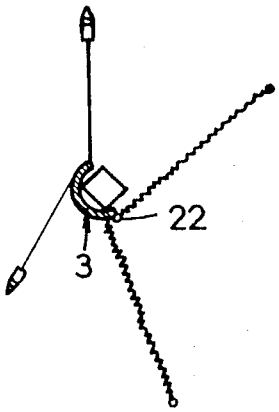
FIGS. 12 to 19 illustrate different phases in the positioning of the protective barrier around the existing platform/structure.
Figure 14:
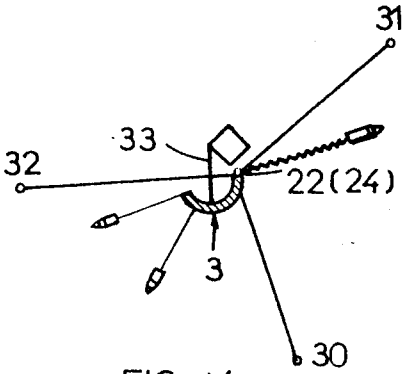
Figure 13:
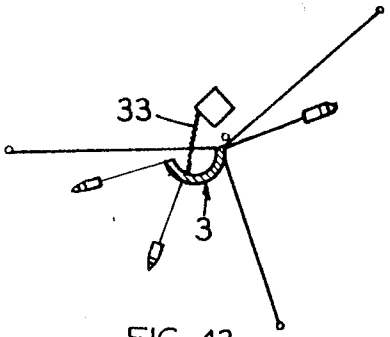
Figure 12:
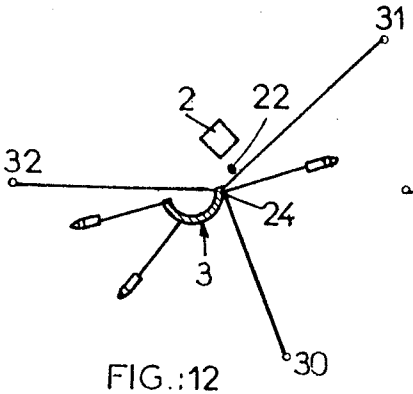
Figure 19:
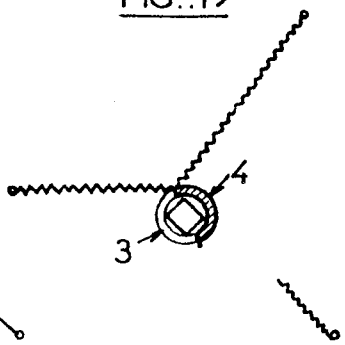
Figure 18:
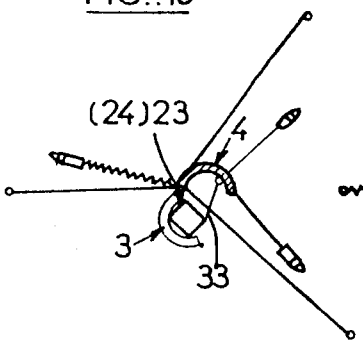
Figure 17:
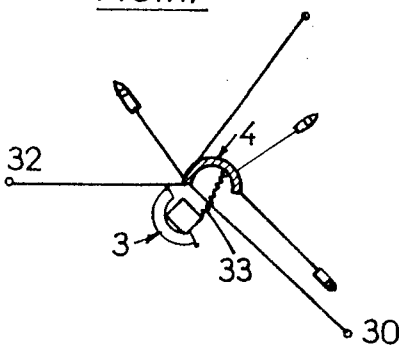
Figure 16:
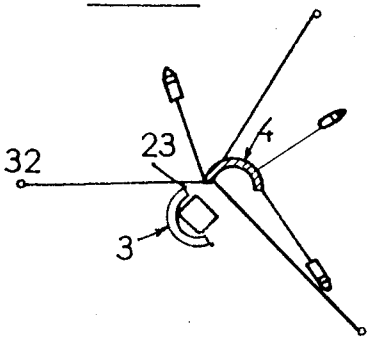

The element 3 is moored to the ends of the mooring lines, and by the action of winches on the mooring cables (FIGS. 12), the part 24 of the docking sleeve, carried by the ends 26 of the element 3, is brought above the docking pile 22. By ballasting the element and simultaneously lowering the docking sleeve 24, the two parts of the docking mechanism are mutually engaged. A mooring line 33 is installed between the element 3 and the platform to be protected (FIG. 13). By acting upon the winch of the line 33 provided on the platform, and maneuvering at least one of the tugs, the element 3 is rotated about the docking pile 22, thus the element 3 is brought into the final position relative to the platform (FIGS. 14 and 15).

With the element 3 being maintained afloat, a similar procedure is followed to bring the second element 4 into position about either a docking device consisting of a docking sleeve adapted to slide longitudinally to engage with a docking pile 23 or the docking head 27 provided on the side of the element 3 already in place.

When both elements 3 and 4 are in their final position, their connection is effected by passing locking pins through the connection devices and the two elements 3, 4 are then ballasted to make them rest on the sea bed. They are optionally ballasted with a solid ballast 11 so as to give them the characteristics of a gravity structure.

It should be observed that after the positioning of the first element it is possible to ballast it to make it rest on the sea bed, pending the arrival of the second element on site, or if suitable climatic conditions prevail to allow the completion of the installation of the protective barrier.

The orientation of the mooring lines, and also the position of the individual element or elements of the protective barrier required to be positioned, will depend substantially upon the local conditions determined by the prevailing winds, waves, and currents, etc., and will have to be adapted in each case.

What is claimed is:

1. A protective barrier for marine works, comprising at least two ballastable concrete elements, at least partially surrounding a work to be protected, of greater height than the depth of water in which said barrier is to be installed, said elements having vertical sides comprising a connection device for structural continuity of the elements after assembly, said elements being independent of the work to be protected, wherein the connection device comprises conjugate teeth formed in the external and internal walls of the corresponding vertical sides of the elements to be assembled, coaxial cylindrical channels vertically penetrating the teeth, locking pins located in said channels, and cement slurry injected into joints of the teeth and the cylindrical channels to produce structural continuity of the protective barrier.

2. Protective barrier according to claim 1, wherein each of the elements comprises respectively convex and concave external and internal walls divided into vertical adjacent cells closed at least at a lower end thereof by a base slab in the form of an annular segment.

3. Protective barrier according to claim 1, wherein at least one of the vertical sides carries at least one part of a docking device consisting of a docking sleeve adapted to slide longitudinally to engage with a docking head.

4. Protective barrier according to claim 3, wherein the docking head of said docking device is carried by a docking pile driven into the seas bead.

5. Protective barrier according to claim 3, wherein the docking head is carried by a vertical side of one of the elements while the docking sleeve is carried by the other element.

6. Method for installing a protective barrier comprising at least two ballastable elements and a connecting device comprising conjugated teeth and coaxial cylindrical channels vertically penetrating the teeth and adapted to receive locking pins, comprising the following steps:

(a) towing an element of the protective barrier to the site;

(b) driving at least three mooring piles into the sea bed, and equipping said piles with mooring lines to be connected to mooring cables attached to the element through the intermediary of winches;

(c) driving at least one docking pile at a definite distance from the work to be protected;

(d) bringing, by maneuvering the cables, the first element of the protective barrier above a docking head so as to effect the engagement of a docking sleeve carried by the element, with the docking head by ballasting the element and vertical movement of that part of the docking sleeve carried by the element;

(e) passing a mooring line between the marine work to be protected and the element so as to position the element by rotation about the docking pile;

(f) bringing the element into position by traction on the mooring line;

(g) repeating the same operations of steps (a) to (f) in order to bring subsequent elements into position;

(h) locking the connection device by the locking pins;

(i) repeating steps (a) to (h) as many times as there are elements;

(j) ballasting the element when connected to make it rest on the sea bed;

(k) injecting a cement slurry into voids between the teeth, between the pins and the cylindrical channels and inside the locking pins of the connection device;

(l) ballasting the elements with solid ballast.

* * * * *